US009909724B2

(12) United States Patent
Marinus et al.

(10) Patent No.: US 9,909,724 B2
(45) Date of Patent: Mar. 6, 2018

(54) LIGHTING DEVICE WITH REMOTE WAVELENGTH CONVERTING ELEMENT

(71) Applicant: PHILIPS LIGHTING HOLDING B.V., Eindhoven (NL)

(72) Inventors: Antonius Adrianus Maria Marinus, Eindhoven (NL); Vincent Stefan David Gielen, Eindhoven (NL); Wiebe Wagemans, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/827,817

(22) Filed: Aug. 17, 2015

(65) Prior Publication Data

US 2016/0047514 A1 Feb. 18, 2016

(30) Foreign Application Priority Data

Aug. 18, 2014 (EP) ..... 14181229

(51) Int. Cl.

| | |
|---|---|
| ***F21K 99/00*** | (2016.01) |
| ***F21V 3/04*** | (2006.01) |
| ***F21V 17/02*** | (2006.01) |
| ***F21K 9/90*** | (2016.01) |
| ***F21V 17/10*** | (2006.01) |
| ***F21K 9/232*** | (2016.01) |
| ***F21K 9/64*** | (2016.01) |

(Continued)

(52) U.S. Cl.

CPC ..... *F21K 9/90* (2013.01); *F21K 9/232* (2016.08); *F21K 9/64* (2016.08); *F21V 17/107* (2013.01); *F21K 9/23* (2016.08); *F21V 3/0418* (2013.01); *F21V 3/0436* (2013.01); *F21Y 2113/13* (2016.08); *F21Y 2115/10* (2016.08)

(58) Field of Classification Search

CPC ..... F21K 9/64; F21K 9/23; F21K 9/232
USPC ..... 445/27, 32, 66, 67; 362/84
See application file for complete search history.

(56) References Cited

U.S. PATENT DOCUMENTS 223,898 A * 1/1880 Edison ..... H01K 3/00 201/25
2,904,710 A * 9/1959 Beeninga ..... H01J 61/34 313/113

(Continued)

FOREIGN PATENT DOCUMENTS

CN 203517383 U 4/2014
JP 2011009021 A 1/2011

(Continued)

*Primary Examiner* — Jong-Suk (James) Lee
*Assistant Examiner* — Colin Cattanach
(74) *Attorney, Agent, or Firm* — Akarsh P. Belagodu

(57) ABSTRACT

A lighting device (1) is provided comprising at least one light source (3), a wavelength converting element (8) adapted to convert a wavelength of light emitted by the at least one light source, at least one support (7) arranged to support the wavelength converting element remote from the at least one light source, and an envelope (2) adapted to enclose the wavelength converting element and at least a portion of the at least one support. The at least one support is arranged to be able to pivot relative to the wavelength converting element. The present lighting device enables using a rigid wavelength converting element and an at least partially rigid support, as these two components may be moved relative to each other for facilitating insertion of the unit in the envelope.

14 Claims, 4 Drawing Sheets

(51) Int. Cl.

| | |
|---|---|
| *F21K 9/23* | (2016.01) |
| *F21Y 115/10* | (2016.01) |
| *F21Y 113/13* | (2016.01) |

(56) References Cited

U.S. PATENT DOCUMENTS 4,341,975 A * 7/1982 Phillipp ..... H01J 61/34 313/25
4,936,807 A * 6/1990 Kowal ..... H01J 9/265 445/2
4,990,819 A * 2/1991 Narby ..... H01J 61/82 313/25
5,229,681 A * 7/1993 Gordin ..... H01J 61/34 313/113
5,856,721 A * 1/1999 Gordin ..... H01J 61/82 313/113
6,523,978 B1 * 2/2003 Huang ..... F21V 3/00 313/500
6,586,882 B1 * 7/2003 Harbers ..... H01L 25/13 257/E25.028
7,618,175 B1 * 11/2009 Hulse ..... F21S 10/02 362/555
9,285,086 B2 * 3/2016 Genier ..... F21K 9/52
2004/0008525 A1 * 1/2004 Shibata ..... F21K 9/232 313/271
2008/0137360 A1 * 6/2008 Van Jijswick ..... G02B 6/001 362/555
2009/0026982 A1 * 1/2009 Lee ..... H05B 33/0803 315/312
2009/0141474 A1 * 6/2009 Kolodin ..... F21V 3/04 362/84
2010/0123393 A1 * 5/2010 Tu ..... H01J 61/34 313/621
2010/0124243 A1 * 5/2010 Hussell ..... F21K 9/00 372/45.01
2011/0140593 A1 * 6/2011 Negley ..... F21K 9/64 313/502
2011/0215345 A1 * 9/2011 Tarsa ..... F21V 3/02 257/88
2011/0215699 A1 * 9/2011 Le ..... F21V 3/00 313/46
2011/0216552 A1 * 9/2011 Hattori ..... F21K 9/64 362/553
2012/0057327 A1 * 3/2012 Le ..... F21V 3/02 362/84
2012/0162965 A1 * 6/2012 Takeuchi ..... F21K 9/232 362/84
2012/0176804 A1 7/2012 Bohler et al.
2012/0286643 A1 * 11/2012 Ozin ..... B82Y 20/00 313/112
2012/0320580 A1 12/2012 Liang
2013/0265796 A1 * 10/2013 Kwisthout ..... F21K 9/232 362/555
2016/0025273 A1 * 1/2016 van de Ven ..... F21K 9/64 362/293
2016/0041324 A1 * 2/2016 Nava ..... G02B 6/0001 362/311.01

FOREIGN PATENT DOCUMENTS

JP 2011187361 A 9/2011
WO 200063977 A1 10/2000
WO 2013064344 A1 5/2013

* cited by examiner

LIGHTING DEVICE WITH REMOTE WAVELENGTH CONVERTING ELEMENT

CROSS-REFERENCE TO PRIOR APPLICATIONS

This application claims the benefit of European Patent Application No. 14181229.7, filed on Aug. 18, 2014. This application is hereby incorporated by reference herein.

FIELD OF THE INVENTION

The present invention generally relates to the field of lighting devices comprising a remote wavelength converting element.

BACKGROUND OF THE INVENTION

Traditional incandescent lighting devices are currently being replaced by more energy efficient solid state based light sources, such as light emitting diode (LED) based light sources. Solid state based light sources have significantly different optical characteristics compared to incandescent light sources. In particular, solid state based light sources provide a more directed light distribution and a higher (i.e. cooler) color temperature compared to incandescent light sources. Therefore, efforts have been made in order to make solid state based lighting devices to better resemble traditional incandescent lighting devices in terms of light distribution and color temperature.

Wavelength converting material, such as phosphor, is normally used to adjust the color temperature of light emitted by light sources. The wavelength converting material may be positioned directly on the light source or in a separate element spaced from the light source, the latter normally being referred to as a remote wavelength converting element.

US 2012/0176804 shows a lighting device comprising an LED emitting ultraviolet (UV) light, which is converted by phosphor into visible light (such as white light). The phosphor is disposed at a light guide, which is a planar panel disposed above the LED such that the majority of the light emitted by the LED strikes the panel. The light guide and the LED are covered by an envelope. A drawback with such a lighting device is that it may be difficult to manufacture if the light guide is larger than the bottom opening of the envelope. It may e.g. require that the envelope is made in two pieces or that the light guide is made in a flexible material.

SUMMARY OF THE INVENTION

It would be advantageous to achieve a lighting device overcoming, or at least alleviating, the above mentioned drawbacks. In particular, it would be desirable to enable a lighting device which is easier to manufacture.

To better address one or more of these concerns, a lighting device and a method of manufacturing a lighting device having the features defined in the independent claims are provided. Preferable embodiments are defined in the dependent claims.

Hence, according to an aspect, a lighting device is provided. The lighting device comprises at least one light source, a wavelength converting element adapted to convert a wavelength of light emitted by the at least one light source, at least one support arranged to support the wavelength converting element remote from the at least one light source, and an envelope adapted to enclose the wavelength converting element and at least a portion of the at least one support. The at least one support is arranged to be able to pivot relative to the wavelength converting element.

As the support is able to pivot relative to the wavelength converting element, the support and the wavelength converting element may be moved relative to each other upon assembly of the lighting device. Thus, the support and the wavelength converting element may be assembled into one unit prior to insertion in the envelope. The wavelength converting element and the support may then be pivoted relative to each other so as to be set in a state facilitating insertion of the unit into the envelope. Subsequently, the unit may be pivoted into a final state inside the envelope. The present aspect enables using a rigid wavelength converting element and an at least partially rigid support, as these two components may be moved relative to each other for facilitating insertion of the unit in the envelope. By enabling the use of an at least partially rigid support and a rigid wavelength converting element, a more robust lighting device is provided. Further, the present aspect increases the freedom of designing the shape and orientation of the wavelength converting element inside the envelope as the flexibility of the unit upon insertion is greater compared to a completely rigid arrangement. For example, insertion of the unit inside the envelope via a relatively small opening of the envelope may be facilitated.

Light emitted by the light sources incident on the wavelength converting element may be converted in terms of color and may be reemitted by the wavelength converting element. As the wavelength converting element is supported remote from the light source, i.e. the wavelength converting element is elevated (or spaced) from the light source (and preferably from any heat sink arranged at a base of the lighting device), the light emission from the lighting device is increased in lateral and backward direction, thereby providing a more omnidirectional light distribution of the lighting device. Hence, the lighting device according to the present aspect may better resemble a traditional incandescent lighting device. Further, improved cooling of the lighting device is enabled since the light source may be arranged close to a heat sink with reduced impact on the light distribution.

According to an embodiment, the lighting device may further comprise a base adapted to be coupled to a light socket, wherein the envelope may have an opening adapted to be coupled to the base. For example, the base may be arranged to mechanically and/or electrically couple the lighting device to a light socket. The base may e.g. comprise any type of connector, such as a screw connector or a bi-post connector for connecting the lighting device to a light socket. Optionally, the base may further include driving electronics for driving the light source and/or a heat sink for dissipating heat from the light source. Further, the light source and/or the support may optionally be coupled to the base.

According to an embodiment, the wavelength converting element may have an elongated shape and may be arranged to be able to pivot with respect to the at least one support in a plane extending along a longitudinal direction of the wavelength converting element (i.e. the direction in which the elongated wavelength converting element longitudinally extends). Further, a length of the wavelength converting element as measured along the longitudinal direction may be greater than a maximum width of the opening of the envelope, and a maximum width of the wavelength converting element as measured across (such as perpendicular to) the longitudinal direction may be smaller than the maximum width of the opening of the envelope.

The present embodiment is advantageous in that it enables having an elongated wavelength converting element being relatively long and arranged to extend inside the envelope across an optical axis of the lighting device and a relatively small base, thereby providing increased light emission in backward directions. The support may be arranged to extend in a direction crossing the longitudinal direction of the wavelength converting element when mounted in a final position inside the envelope. For example, the support may be mounted to the base and/or the envelope. In order to enable inserting the unit formed by the wavelength converting element and the support in the envelope via the opening, the support may be pivoted so as to extend (substantially) along the longitudinal direction of the wavelength converting element. The unit may then be moved through the opening of the envelope along its longitudinal direction. As the maximum width (of the cross-section) of the wavelength converting element is less than the maximum width (such as the diameter) of the opening of the envelope, the unit can pass the opening of the envelope. Hence, the shape of the cross-section of the wavelength converting element may be adapted to pass through the opening of the envelope. The present embodiment allows using an envelope made of a single piece of material since the unit can be inserted in the envelope via the opening of the base. Hence, no visible glue or welding joint may be present in the envelope.

For example, the wavelength converting element may be pivotal with respect to the at least one support around an axis crossing (such as being substantially perpendicular to) a longitudinal direction of the wavelength converting element.

According to an embodiment, the at least one support may comprise two supports, each one arranged to be able to pivot relative to the wavelength converting element, which is advantageous in that the orientation of the wavelength converting element may be adjusted after it has been inserted in the envelope by adjusting the positions of the two supports. For example, if the two supports are moved in substantially opposite directions along their respective longitudinal directions, the wavelength converting element may be tilted.

Alternatively, the lighting device may comprise a single support or any other number of supports.

According to an embodiment, each of the two supports may be arranged to be able to pivot with respect to the wavelength converting element in a plane, and the planes may extend along each other. For example, each of the two supports may pivot with respect to the wavelength converting element around an axis, and the axes may extend along the same direction. Hence, the pivotal planes of the two supports may be substantially parallel. Further, the pivot axes of the two supports may be substantially parallel. With the present embodiment, the unit formed by the wavelength converting element and the supports may be pivoted so as to extend along substantially the same direction, thereby facilitating inserting the unit in the envelope.

It will be appreciated that the one or more supports may be arranged to pivot in more than one plane.

According to an embodiment, the at least one light source may be adapted to emit ultraviolet (UV) light, whereby light emitted directly from the light source without passing the wavelength converting element may not be visible and the wavelength converting element may appear as the only light source in the lighting device. Further, the supports may be hardly visible in the UV light, whereby the wavelength converting element may appear to float inside the envelope. For example, the light source may be a UV (preferably UV-A) LED. In addition, or as an alternative, the light source may be adapted to emit deep blue light (such as light having a wavelength around 400-420 and preferably around 410 nm) and/or white light.

According to an embodiment, the at least one light source may be adapted to emit light at least in a first wavelength range, and the wavelength converting element may be adapted to convert light emitted by the at least one light source into at least a second wavelength range different from the first wavelength range. The envelope may be adapted to hinder at least a portion of the light emitted by the at least one light source in the first wavelength range to exit the lighting device, thereby making the light source less visible from outside the envelope and the wavelength converting element may appear as the only light emitting component in the lighting device.

For example, the first wavelength range may be the UV wavelength range (such as around 300-400 nm) and optionally also the wavelength range for deep blue visible light (such as around 400-420 nm), and the second wavelength range may be a range within the visible spectrum, such as around 450-750, and preferably around 550-750 nm. As UV light is hindered to pass the envelope, the amount of UV light exiting the lighting device and exciting white objects in the surroundings may be reduced. Material for absorbing and/or reflecting the second wavelength range may e.g. be integrated in the material of the envelope and/or applied as a coating on the envelope.

According to an embodiment, the lighting device may further comprise at least one additional light source adapted to emit light within the second wavelength range (such as within a visible spectrum). Hence, the light emitted by the additional light source may be directly visible without having to pass the wavelength converting element. The additional light source may be arranged so as to achieve a desired light distribution pattern of the lighting device. The additional light source may e.g. be adapted to emit white, yellow, amber or red light.

According to an embodiment, the wavelength converting element may be adapted to convert light emitted by the at least one light source into at least one of the colors: white, yellow, amber and red, thereby resembling the light of an incandescent light source.

According to an embodiment, the wavelength converting element may comprise a light transmissive body and a wavelength converting material disposed at the light transmissive body. For example, the wavelength converting material may be arranged in a pattern at the light transmissive body. Portions of the wavelength converting element not provided with wavelength converting material may be less visible while the portions provided with wavelength converting material may emit light and be more visible. For example, the wavelength converting material may be arranged in a filament-like manner so as to better resemble an incandescent lighting device. For example, the wavelength converting material may comprise phosphor.

According to an embodiment, the envelope may be made in a single piece of material, such as glass or plastic. As the unit formed by the wavelength converting element and the support can be pivoted (or folded) upon insertion in the envelope, the need of having a two piece envelope assembled to surround the unit is reduced. Instead, the unit may be inserted via the opening of the envelope adapted to be coupled to the base. Thus, welding or gluing joints in the envelope may be reduced or even eliminated.

According to an embodiment, the envelope may be clear transparent, whereby the wavelength converting element may be more clearly visible through the envelope.

According to an embodiment, each one of the wavelength converting element and the at least one support may be at least partly rigid, thereby making the lighting device more robust, and enabling use of cheaper materials, such as glass, rigid plastic and/or metal. The support and the wavelength converting element can be pivoted (or folded) relative to each other for enabling inserting the unit into the envelope even though a major portion of each one of the wavelength converting element and the support is rigid.

For example, the support may be (at least almost) completely rigid and the pivotal motion between the support and the wavelength converting element may be achieved by a hinged connection between the support and the wavelength converting element. Alternatively, a portion of the support coupled to the wavelength converting element may be flexible and another (preferably major) portion of the support may be rigid so as to allow the rigid portion of the support to pivot relative to the wavelength converting element by bending the flexible portion.

According to an embodiment, the at least one support may comprise at least one bar, which preferably may be relatively thin for making it less visible. The bar may be made of metal and/or rigid plastic. For example, the support may comprise a metal wire, which may simply be bent into the desired shape.

According to another aspect, the lighting device as defined in anyone of the preceding embodiments may be manufactured by a method comprising providing a unit comprising the wavelength converting element arranged to be able to pivot relative to the at least one support, pivoting the wavelength converting element relative to the at least one support into a state enabling insertion of the unit in the envelope, inserting the unit in the envelope, and pivoting the wavelength converting element relative to the at least one support into a final state inside the envelope.

It is noted that embodiments of the invention relates to all possible combinations of features recited in the claims. Further, it will be appreciated that the various embodiments described for the lighting device are all combinable with embodiments of the method.

BRIEF DESCRIPTION OF THE DRAWINGS

These and other aspects will now be described in more detail with reference to the appended drawings showing embodiments.

All the figures are schematic, not necessarily to scale, and generally only show parts which are necessary in order to elucidate the embodiments, wherein other parts may be omitted or merely suggested. Like reference numerals refer to like elements throughout the description.

DETAILED DESCRIPTION

The present aspect will now be described more fully hereinafter with reference to the accompanying drawings, in which currently preferred embodiments are shown. This invention may, however, be embodied in many different forms and should not be construed as limited to the embodiments set forth herein; rather, these embodiments are provided for thoroughness and completeness, and fully convey the scope of the present aspect to the skilled person.

Figure 1:
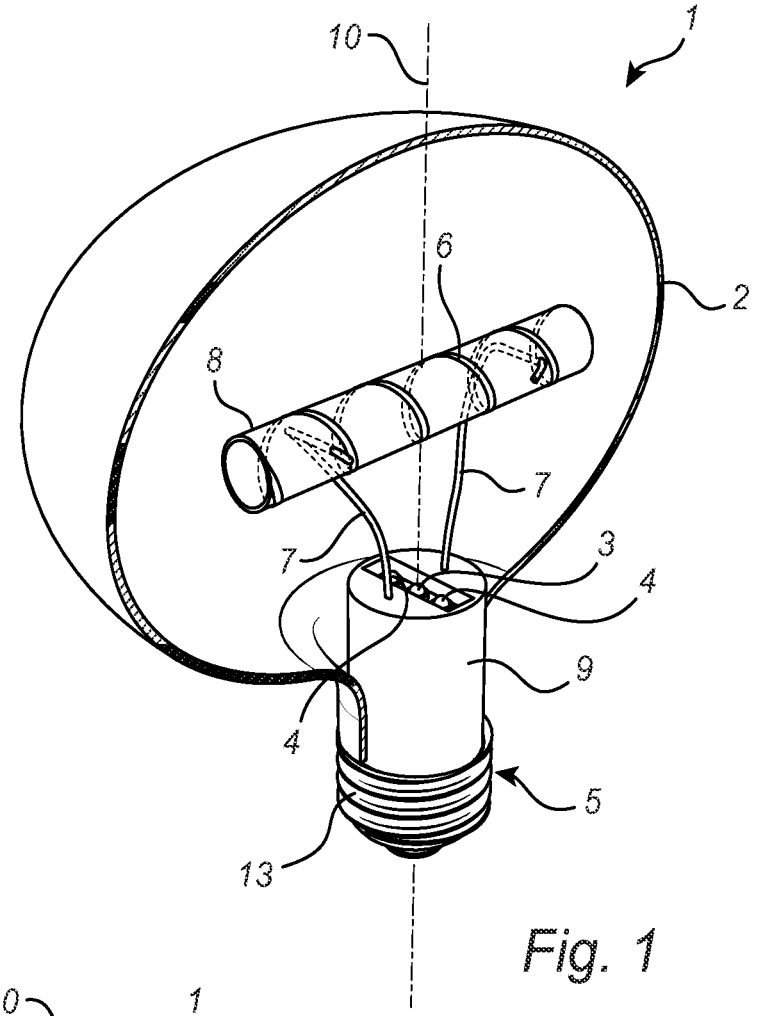
FIG. 1 is a partly cut-away view of a lighting device according to an embodiment.
Figure 2:
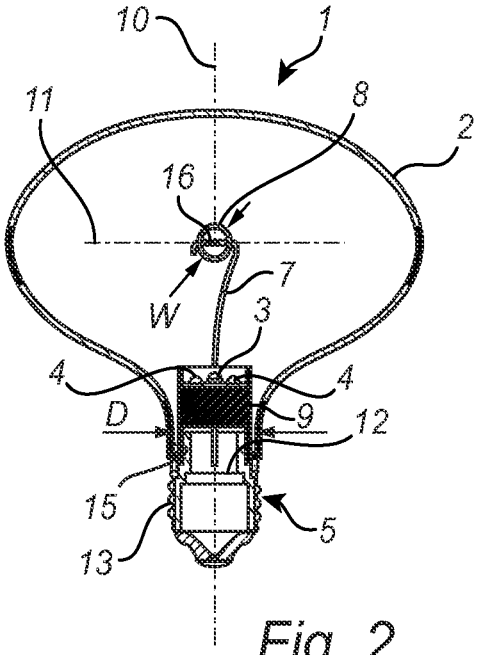
FIG. 2 is a cross-section taken perpendicular to a longitudinal direction of a wavelength converting element of the lighting device.
Figure 3:
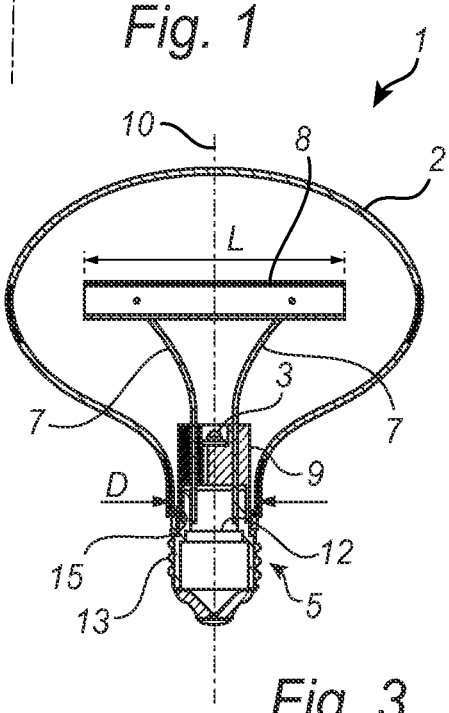
FIG. 3 is a cross-section taken along the longitudinal direction of the wavelength converting element of the lighting device.

A lighting device 1 according to an embodiment will be described with reference to FIG. 1 showing a perspective, partly cut-away view of the lighting device 1 and FIGS. 2 and 3 showing two different cross-sections of the lighting device 1.

The lighting device 1 may comprise a base 5 and an envelope 2 (which also may be referred to as a cover) directly or indirectly coupled to the base 5. For example, an opening 15 of the envelope 2 may be coupled to the base 5. The base 5 may be adapted to mechanically and electrically connect the lighting device 1 to a light socket, which e.g. may be comprised in a light fitting. In the present example, the base 5 comprises a screw connection 13 for coupling the lighting device 1 to a screw type socket. Other connections may be envisaged, such as a bi-pin connection. The lighting device 1 may further comprise one or more light sources 3, 4, such as solid state based light sources, which e.g. may be directly or indirectly coupled to the base 5. The lighting device 1 may further comprise driving electronics 12 for driving the light sources 3, 4. For example, the driving electronics 12 may be comprised in (or coupled to) the base 2. A heat sink 9 may be provided for cooling the light sources 3, 4 and preferably also the driving electronics 12. The heat sink 9 may be comprised in (or coupled to) the base 5. In the present example, the heat sink 9 is coupled to the screw connection 13 and is at least partly covered by the envelope 2. The envelope 2 may preferably be made in a single piece of material, such as glass or plastic. For example, the envelope 2 may be transparent (i.e. clear), so as to make the components inside the envelope 2 clearly visible.

The lighting device 1 may further comprise a wavelength converting element 8 arranged remote from, such as above, the light sources 3, 4. The wavelength converting element 8 may be supported by one or more supports 7 inside the envelope 2. The wavelength converting element 8 may comprise a light transmissive, such as transparent (i.e. clear), body at which wavelength converting material 6 may be arranged. In the present example, the wavelength converting material 6 is arranged in a pattern, such as a helix or double helix, on the light transmissive body. The patterned wavelength converting material 6 may resemble a filament of a traditional incandescent lighting device. The wavelength converting material 6 may e.g. comprise yellow and/or red phosphor. For example, a sleeve of phosphor 6 may be applied to the light transmissive body, e.g. by means of glue. Alternatively, the phosphor may be dispersed in the material of the light transmissive body. The light transmissive body may be hollow or solid. For example, the light transmissive body may be made of glass or rigid plastic.

In the present example, one of the light sources 3 is arranged to emit ultraviolet (UV) light towards the wavelength converting element 8, which re-emits the light in a visible wavelength range, such as white, yellow or red. For example, the light source 3 may be adapted to emit UV-A light with a peak wavelength between 360 and 380 nm. Further, optics (not shown) may be arranged to focus light emitted by the light source 3 towards the wavelength converting element 8. The envelope 2 may preferably be arranged to absorb and/or reflect UV light so as to avoid UV light exiting the lighting device 1. For example, the envelope 2 may be coated with a UV absorbing coating. As UV light is not visible to the human eye, the light will appear as coming merely from the wavelength converting element 8. In order to improve the efficiency of the lighting device 1, a UV reflective coating (such as a dichroic coating) may be applied to the envelope 2 so as to reflect UV light back into the envelope 2 towards the wavelength converting element 8. Optionally, the lighting device 1 may comprise one or more additional light sources 4 adapted to emit light in the visible wavelength range (such as white, yellow, amber or red light) so as to provide additional light intensity of the lighting device 1. Further, a reflector may be arranged to reflect light emitted by the light sources 3, 4 towards the wavelength converting element 8.

The wavelength converting element 8 may have an elongated shape. In the present example, the wavelength converting element 8 is formed as a rod. The wavelength converting element 8 may be arranged so as to extend inside the envelope 2 across an optical axis 10 of the lighting device 1. A length L of the wavelength converting element 8 as measured along a longitudinal direction of the wavelength converting element 8 may be greater than a maximum width (e.g. diameter) D of the opening 15 of the envelope 2, as illustrated in FIG. 3. Further, the maximum width W of the wavelength converting element 8 as measured across (such as perpendicular to) the longitudinal direction of the wavelength converting element 8 may be less than the maximum width D of the opening 15 of the envelope 2.

Each support 7 may be pivotally coupled to the wavelength converting element 8 so as to pivot around an axis 11. For example, a hinge connection between the wavelength converting element 8 and the supports 7 may be provided. In the present example, each support 7 is formed by a metal wire, a portion 16 of which extends through an aperture of the wavelength converting element 8, as illustrated in FIG. 2. An end of the metal wire may be bent so as to keep the support in place with respect to the wavelength converting element 8. Further, the supports 7 may be mounted to the base 2 or, alternatively, to the envelope 2 (not shown). The pivot axes 11 of the supports 7 may preferably extend across (such as perpendicular to) the longitudinal direction of the wavelength converting element 8 such that the supports 7 are able to pivot in a plane substantially parallel with the longitudinal direction of the wavelength converting element 8. Further, the pivot axes 11 may extend substantially in the same direction, such as substantially parallel to each other. Each support 7 may preferably extend mainly in a direction crossing (such as being substantially perpendicular to) the pivot axis 11, preferably between the wavelength converting element 8 and the base 5, when mounted in a final position in the envelope 2.

Figure 4:
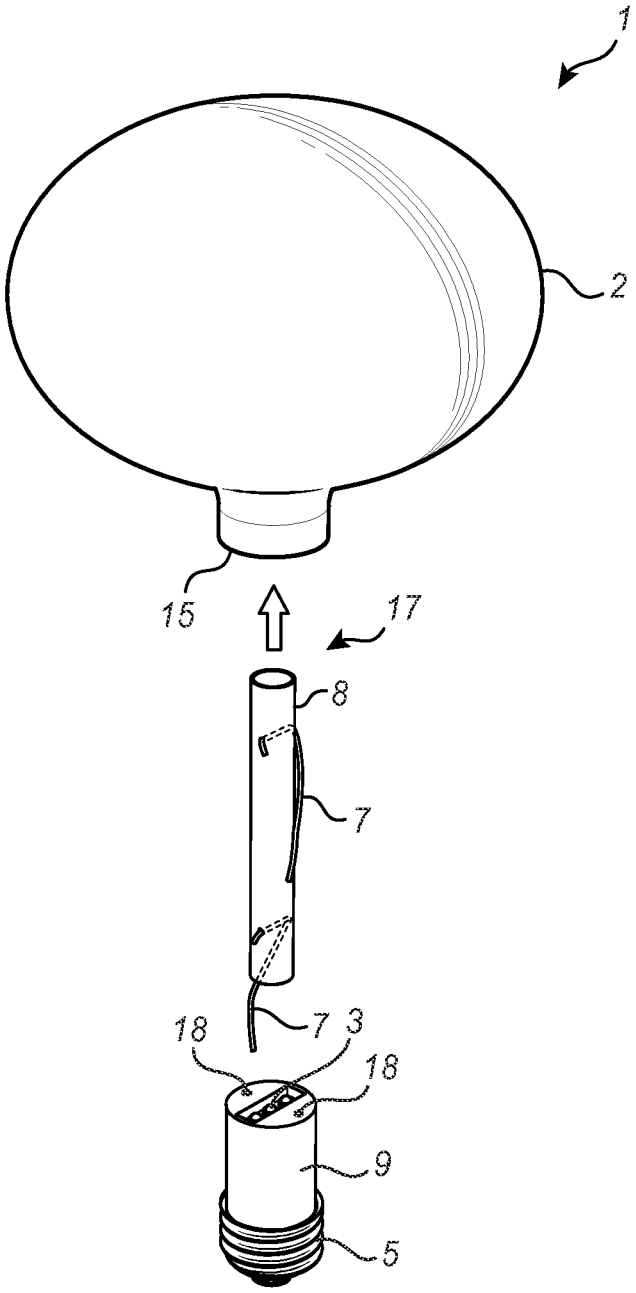
FIG. 4 illustrates the lighting device shown in FIG. 1 being assembled.
Figure 5:
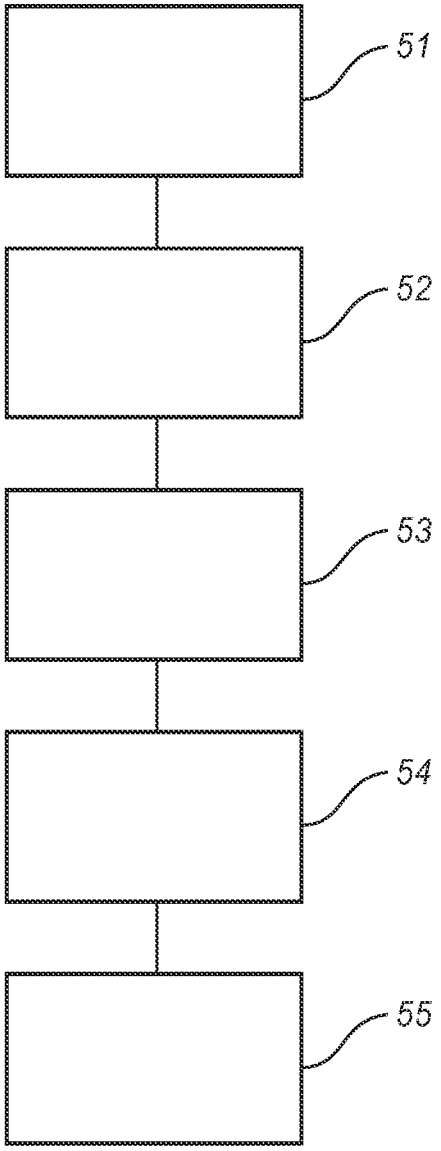
FIG. 5 illustrates a method of manufacturing the lighting device shown in FIG. 1.

A method of manufacturing the lighting device 1 as described with reference to FIGS. 1 to 3 according to an embodiment will be described with reference to FIGS. 4 and 5. FIG. 4 shows the lighting device 1 being assembled during manufacturing of the lighting device 1. FIG. 5 schematically illustrates the method of manufacturing the lighting device 1.

A unit 17 may first be provided 51 by pivotally mounting the supports 7 to the wavelength converting element 8, e.g. by inserting each metal wire 7 and bending an end of the metal wire 7 so as to lock the support 7 in the axial direction of the hinge. The wavelength converting element 8 may then be pivoted 52 relative to the supports 7 into a state enabling insertion of the unit 17 in the envelope 2. For example, the supports 7 may be pivoted (or folded) so as to extend substantially along the longitudinal direction of the wavelength converting element 8, as illustrated in FIG. 4. The unit 17 may then be inserted 53 in the envelope 2, preferably via the opening 15. For example, the unit 17 may be inserted through the opening 15 along its longitudinal direction, as illustrated in FIG. 4. The unit 17 formed by the wavelength converting element 8 and the at least one support 7 may preferably be adapted such that the width of the unit 17 when the support 7 is folded against the wavelength converting element 8 (as illustrated in FIG. 4) is less than the width (or diameter) of the opening 15, so as to enable the unit 17 to pass through the opening 15.

When the unit 17 is positioned at least partially inside the envelope 2, the wavelength converting element 8 may be pivoted 54 relative to the supports 7 into a desired final state inside the envelope 2 (i.e., the state as illustrated e.g. in FIG. 1). The orientation of the wavelength converting element 8 may be tilted as desired by moving the supports 7 in their respective longitudinal directions. Preferably, the wavelength converting element 8 may be tilted so as to extend in a direction crossing the optical axis of the lighting device 1.

The base 5 may then be mounted 55 to the opening 15 of the envelope 2. For example, the base 5 may be provided with one or more holes 18, into which the one or more supports 7 may be inserted so as to attach the supports 7 to the base 5. The holes 18 may e.g. be arranged in the heat sink 9.

Figure 6:
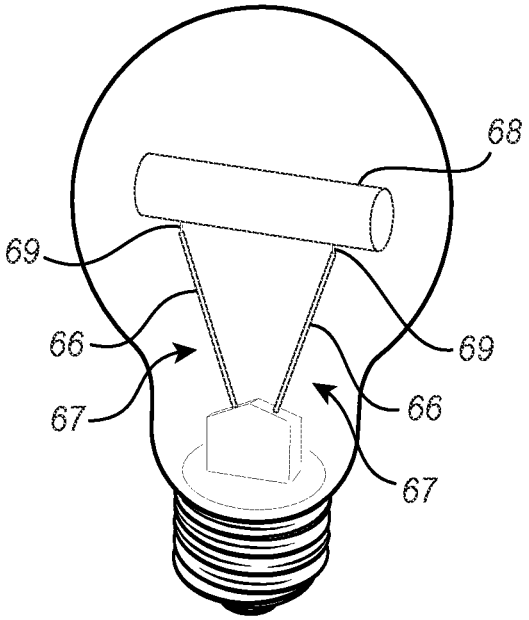
FIG. 6 shows a lighting device according to another embodiment.

A lighting device according to another embodiment will be described with reference to FIG. 6. FIG. 6 shows a lighting device 61, which may be similarly configured as the lighting device according the example described with reference to FIGS. 1 to 3, except that the supports 67 may comprise a rigid portion 66 and a flexible portion 69, wherein the flexible portions 69 connects the rigid portions 66 to the wavelength converting element 68. The supports 67 are arranged to be able to pivot relative to the wavelength converting element 68 as the flexible portions 69 can be bent. The flexible portions 69 may e.g. comprise a bendable thin metal wire. The rigid portions 66 may e.g. comprise a rigid tube, bar or the like made e.g. of plastic or glass. The lighting device 61 may be manufactured according to the manufacturing method as described with reference to FIGS. 4 to 5.

The person skilled in the art realizes that the present invention by no means is limited to the preferred embodiments described above. On the contrary, many modifications and variations are possible within the scope of the appended claims. For example, other shapes than an elongated shape of the wavelength converting element may be envisaged, such as a spherical, cubical or any other convenient shape.

Additionally, variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or an does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A lighting device comprising:

at least one light source;

a wavelength converting element adapted to convert a wavelength of light emitted by the at least one light source, at least one support arranged to support the wavelength converting element remote from the at least one light source; and an envelope adapted to enclose the wavelength converting element and at least a portion of the at least one support, wherein the at least one support is pivotable, about a pivot axis, between a first position and a second position relative to the wavelength converting element, a portion of the at least one support extends along the pivot axis through the wavelength converting element transverse to a longitudinal axis of the wavelength converting element, wherein the at least one support further comprises a hook-shaped end configured to grasp the wavelength converting element, and a support end, opposite the hooked end, extending in a direction crossing the pivot axis.

2. The lighting device as defined in claim 1, further comprising a base adapted to be coupled to a light socket, wherein the envelope has an opening adapted to be coupled to the base.

3. The lighting device as defined in claim 2, wherein the wavelength converting element has an elongated shape and is arranged to be able to pivot with respect to the at least one support in a plane extending along a longitudinal direction of the wavelength converting element, wherein a length of the wavelength converting element as measured along said longitudinal direction is greater than a maximum width of the opening of the envelope, and wherein a maximum width of the wavelength converting element as measured across said longitudinal direction is smaller than the maximum width of the opening of the envelope.

4. The lighting device as defined in claim 1, wherein the at least one support comprises two supports, each one arranged to be able to pivot relative to the wavelength converting element.

5. The lighting device as defined in claim 4, wherein each support is arranged to be able to pivot with respect to the wavelength converting element in a plane, and wherein the planes extends along each other.

6. The lighting device as defined in claim 1, wherein the at least one light source is adapted to emit ultraviolet light.

7. The lighting device as defined in claim 1, wherein the at least one light source is adapted to emit light at least in a first wavelength range, wherein the wavelength converting element is adapted to convert light emitted by the at least one light source into at least a second wavelength range different from the first wavelength range, and wherein the envelope is adapted to hinder at least a portion of the light emitted by the at least one light source in the first wavelength range to exit the lighting device.

8. The lighting device as defined in claim 7, further comprising at least one additional light source adapted to emit light within the second wavelength range.

9. The lighting device as defined in claim 1, wherein the wavelength converting element is adapted to convert light emitted by the at least one light source into at least one of the colors: white, yellow, amber and red.

10. The lighting device as defined in claim 1, wherein the wavelength converting element comprises a light transmissive body and a wavelength converting material disposed at the light transmissive body.

11. The lighting device as defined in claim 1, wherein the envelope is made in a single piece of material.

12. The lighting device as defined in claim 1, wherein the envelope is clear transparent.

13. The lighting device as defined in claim 1, wherein the at least one support comprises at least one bar.

14. The lighting device as define in claim 10, wherein the wavelength converting material is arranged about the light transmissive body in the shape of a helix.

* * * * *